United States Patent [19]

Allen

[11] Patent Number: 4,985,193

[45] Date of Patent: Jan. 15, 1991

[54] ARAMID YARN PROCESS

[75] Inventor: Steven R. Allen, Wilmington, Del.

[73] Assignee: E. I. du Pont de Nemours and Company, Wilmington, Del.

[21] Appl. No.: 312,651

[22] Filed: Feb. 21, 1989

[51] Int. Cl.[5] ..... D01F 6/60

[52] U.S. Cl. ..... 264/184; 264/203; 264/205; 264/210.7; 264/210.8; 264/211.15; 264/211.16; 264/233

[58] Field of Search ..... 264/184, 203, 210.8, 264/289.3, 290.5, 210.7, 205, 210.7, 211.15, 211.16, 233

[56] References Cited

U.S. PATENT DOCUMENTS

| | | | |
|---|---|---|---|
| 3,767,756 | 10/1973 | Blades | 264/184 |
| 3,869,429 | 3/1975 | Blades | 260/78 |
| 4,726,922 | 2/1988 | Cochran et al. | 264/184 |

FOREIGN PATENT DOCUMENTS

| | | |
|---|---|---|
| 53-98415 | 8/1978 | Japan . |
| 55-11763 | 3/1980 | Japan . |
| 55-11764 | 3/1980 | Japan . |
| 60-88117 | 5/1985 | Japan . |
| 61-167105 | 7/1986 | Japan . |

*Primary Examiner*—Hubert C. Lorin

[57] ABSTRACT

A process for preparing high modulus, high tenacity fibers of aromatic polyamide wherein a first constant tension within 40–95% of the fiber breaking load is applied to washed fibers at a temperature of less than 50° C. for a duration of greater than 5 seconds, and drying the fibers at a second constant tension which is from 10–100% of the first constant tension and at a temperature of more than the temperature of the first constant tension and less than 350° C. until the fibers have a moisture content of about 2 to 10%.

7 Claims, 2 Drawing Sheets

ARAMID YARN PROCESS

TECHNICAL FIELD

This invention relates to an improved process for preparing fibers of aromatic polyamides whose chain extending bonds are coaxial or parallel and oppositely directed. The process relates primarily to post-spinning treatment of such fibers which are hereinafter referred to as para-aramid fibers.

BACKGROUND ART

U.S. Pat. No. 3,767,756 describes a process for spinning para-aramids to provide fibers having excellent as-spun tenacity, modulus and breaking elongation. The p-aramid fibers obtained by the above-referenced spinning process have excellent properties but even further improvement in tenacity and modulus is often desired. U.S. Pat. No. 3,869,429 teaches that drying para-aramid fibers obtained using such processes under tensions less than about 0.3 gpd is preferred; but, that drying the fibers above 0.3 gpd reduces the breaking elongation of the fibers while increasing the modulus.

Japanese Laid-Open Patent Application (Kokai) Ser. No. 98,415/78 discloses a post spinning drying treatment of para-aramid fibers wherein the fibers are subjected to a single-step drying under a constant draw-ratio of about 20–90% of ultimate fiber elongation at a temperature of less than about 200° C.

Japanese Patent Publication No. 11763/80 discloses a post-spinning fiber treatment of para-aramid fibers wherein the fibers: are drawn about 20–80% of maximum elongation at a temperature of less than 100° C. while retaining residual spinning solvent in an amount of 100% of the weight of the dry fiber; are washed to remove the residual spinning solvent; and are dried and heat treated at a temperature greater than 300° C. under tension which would provide constant length.

Japanese Patent Publication No. 11764/80 discloses a post-spinning fiber treatment of para-aramid fibers wherein the fibers: are washed in water; are drawn about 20–90% of maximum elongation while wet and in saturated steam at a temperature of greater than 100° C., and are dried and heat treated at a temperature greater than 300° C. under tension which would provide constant length.

Japanese Laid-Open patent application (Kokai) Ser. No. 88,117/85 discloses a post-spinning drying treatment of para-aramid fibers wherein the fibers, with greater than 50% water, are subjected to a stretching step through application of tension of 1–10 gpd and are then subjected to a drying step wherein the same length as with the tension applied is maintained all at a temperature of less than 200° C.

Japanese Laid-Open patent application (Kokai) Ser. No. 167,015/86 discloses a post-spinning drying treatment of para-aramid fibers wherein the fibers are subjected to a tensionless preliminary dewatering to reduce the water content to about 20–80% and are then subjected to a single-step drying under a constant tension of 5–15 gpd and at a temperature of 50°–150° C.

SUMMARY OF THE INVENTION

This invention provides an improved, post-spinning, process for preparing high modulus, high tenacity para-aramid fibers wherein the fibers are washed, drawn at a first constant tension to within 40–95% of breaking load at a temperature of less than about 50° C., for a duration of more than about 3 seconds while containing at least 15% water, and dried at a second constant tension which is from 10–100% of the first constant tension at a temperature of more than the temperature of the first draw and not greater than about 350° C. The drying is completed when the fibers have 2 to 10% water, based on weight of dry polymer.

The invention yields fibers of very high modulus with a tenacity which is not more than 15% lower than the tenacity would have been had there been no post-spinning treatment. The process is characterized by being a two step process wherein: the first step accomplishes an alignment of polymer molecules by drawing at high constant stress, at a low temperature, and in the wet uncollapsed condition; and the second step accomplishes drying of the fiber at a constant stress no greater than the drawing stress.

To be oriented and, thereby, strengthened, the fibers must be subjected to rather high stresses at some time in their manufacture. By means of the two step process of this invention, the fibers are subjected to the high tension at low temperature, when they are still water-swollen and while they are not so easily damaged as when the fibers are being dried at higher temperatures. One important aspect of the present invention resides in the discovery that, by the two steps, the fibers are subjected to the highest tension at temperatures considerably lower than the drying temperatures and, thereby, under conditions where the fibers are much less fragile. The stress and conditions of the first step are such that molecules in the fiber are oriented along the axis of the draw; and the stress and conditions of the second step are such that the fibers are dried with a combination of stress and heat which will yield a minimum of damage to the fibers. In the second step, there is a preferred range for stress and a preferred range for temperature—when stress at the high end of the range is used, temperature at the low end of the range is appropriate to avoid damage of the fiber.

Preferably the para-aramid is poly(p-phenylene terephthalamide), but any para-aramid fiber can be used so long as it has been spun from an anisotropic spin dope using the so-called air-gap spinning process such as is described in U.S. Pat. No. 3,767,756. That process includes extruding an anisotropic solution of aromatic polyamide in 98.0 to 100.2% sulfuric acid having a polyamide concentration of at least 30 g/100 ml sulfuric acid through a layer of non-coagulating fluid into a coagulating bath to yield fibers.

DETAILED DESCRIPTION OF THE INVENTION

Figure 1:
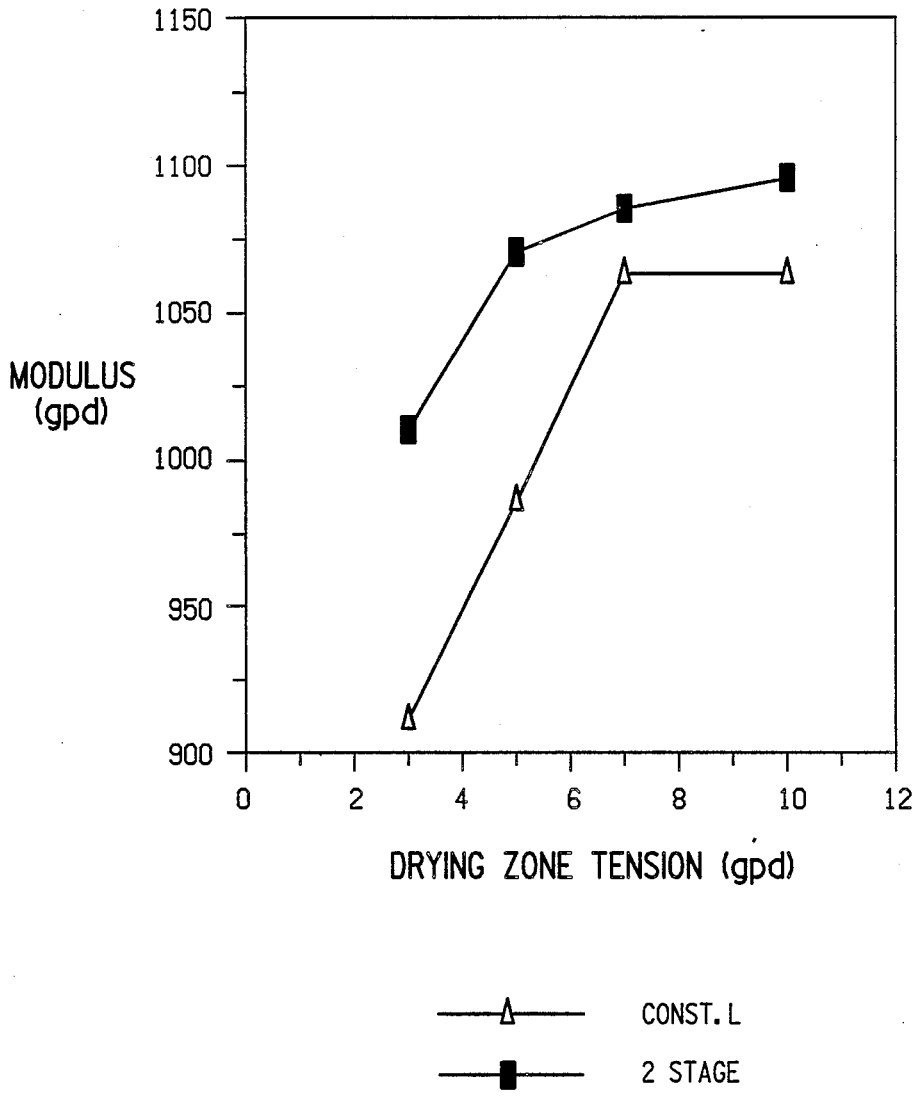
FIG. 1 is a graphical representation of improvement in filament modulus which is realized by the application of constant stress during fiber drying as compared with fiber drying with constant length.

The process of the present invention can be conducted on any never-dried para-aramid fibers made from any para-aramid polymeric material. Poly-p-phenylene terephthalamide homopolymer is preferred and, by "poly-p-phenylene terephthalamide" is meant the homopolymer resulting from mole-for-mole polymerization of p-phenylene diamine and terephthaloyl chloride and, also, copolymers resulting from incorporation of small amounts of other aromatic diamine with the p-phenylene diamine and of small amounts of other aromatic diacid chloride with the terephthaloyl chloride. As a general rule, other aromatic diamines and other aromatic diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. The fibers can be of any denier.

The wet fiber drawing step which precedes drying takes place at ambient temperatures less than 50° C. The tensile load applied to the yarn in this step should exceed 40% of the breaking load but should not be so great as to break or to otherwise mechanically damage the yarn. Tensile loads in the range of 40 to 95% of the fiber breaking load are found to be suitable; and tensile loads in the range of 50 to 80% of the fiber breaking load are preferred. For the purposes of this invention, the breaking load is the stress at which the fiber being treated is found to break under the conditions of the treatment. The drawing step must be performed on swollen, uncollapsed, fibers and can be conducted on fibers which have any amount of water, or equivalent liquid, greater than the minimum amount necessary to maintain an uncollapsed structure. As a general rule, fibers for the drawing step will have from 15 to 100, weight, percent, water, based on dry fiber material and at least 20 percent water is, usually, preferred. If desired or required for a particular purpose, the drawing step can be conducted in aqueous acid or other liquid such as may be found in the fiber coagulating bath. The drawing step is conducted after fiber coagulation has been completed and before fiber collapse due to drying has occurred.

Optimum tensile load for the drying step will depend on the overall conditions used. In any case, damage to the fibers is minimized by maintaining the tensile load for the drying step at no greater than the tensile load employed in the drawing step. Tensile loads during drying are 10 to 100% of the tensile load for drawing; and tensile loads during drying are preferably 20 to 60% of the tensile load for drawing. Preferably, drying involves no direct contact with solid surfaces. The drying step is conducted at temperatures as low as practical, consistent with the object of drying the fiber with a minimum of damage. The drying is usually conducted at temperatures of more than the temperatures of the drawing step and less than about 350° C., preferably less than 200° C.

It is important and critical to practice of this invention that the drawing step and the drying step be conducted at constant tension as opposed to constant length. It has been found that improvement in filament modulus is strongly related to the tension employed in drawing and drying steps of the fiber manufacture During drying at constant length, considerable relaxation of tension occurs; and the degree of the relaxation varies depending upon the initial tension loading, the drying temperature, and the moisture content of the fiber. As a result of that relaxation of tension, drying at constant length permits far less control of the fiber product properties than does drying at constant tension. Tension relaxations of as much as 50% of the initial tension have been observed for drying at constant length. Maintaining constant tension in accordance with this invention provides for continuous drawing and concomitant improvement of molecular orientation and structure consolidation resulting in optimal orientation and properties. The manufacture of para-aramid fibers by means of a combination of constant tension drawing and constant tension drying results in fibers exhibiting surprisingly improved properties as compared with para-aramid fibers made wherein the drawing step or the drying step is conducted at constant length.

Constant tension on the fibers is preferably maintained by suitable control of the surface speed of the rolls used to forward the fibers. Other means of maintaining tension may also be used, such as yarn brakes or idler pulleys and the like.

The tension for the drawing step is preferably as high as can be used without causing a high fiber breakage and is, generally, in the range of 40–95% of the break load. The tension for the drying step is also, preferably as high as can be used without damaging the fibers but is, critically, a function of the temperature of the drying.

After drying, the fibers can be packaged in any way desired, such as, for example, by winding the dried yarn on a spool or bobbin. A finish, or water, may be applied to the fibers before packaging.

The process of this invention can be practiced as a continuous or a batch process. It has also been found to result in fibers of good hydrolytic stability and long flex life.

TESTS

Moisture on Yarn

While this determination is useful at any stage, it is ordinarily used for yarn immediately as received from a drying step so as to measure effectiveness of the drying. Yarn as dried is wound without finish onto a bobbin with enough traverse strokes for four or more yarn layers. On doffing the bobbin its surface layer is stripped off, a sample long enough to weigh at least 0.5 g is removed, and is immediately placed inside a polyethylene bag which is sealed with tape. Weight of bag, tape, and sample is recorded as $W_1$. The sample is placed in an aluminum cup and heated in an oven at 135° to 140° C. for 30 minutes. Meanwhile, weight of bag and tape is recorded as $W_2$ so that $W_1$–$W_2$ becomes the weight of the moist sample. The hot sample in its aluminum cup, on removal from the oven, is immediately placed in a nitrogen-blanketed desiccator and cooled 5 minutes. Then the dry yarn sample alone is weighed to obtain $W_3$. The percent moisture on (or in) yarn (% MOY) as originally collected is calculated from:

$$\% MOY = 100 \times \frac{(W_1 - W_2) - W_3}{W_3}$$

Tensile Properties

Tenacity (breaking tenacity), elongation (breaking elongation), and modulus are determined by breaking test filaments on an Instron tester (Instron Engineering Corp., Canton, Mass.).

Tenacity is reported as the breaking stress of a filament divided by linear density of the filament. Modulus is reported as the slope of the initial stress/strain curve from 0.1 to 0.4% strain converted to the same units as tenacity. Elongation is the percent increase in length at break. (Both tenacity and modulus are first computed in g/denier units which, when multiplied by 0.8826, yield dN/tex units). Each reported measurement is the average of 10 breaks.

Tensile properties for filaments are measured at about 21° C. and about 50–60% relative humidity after conditioning under test conditions for at least 14 hours. A gage length of 2.54 cm is used with an elongation rate of 0.25 cm per minute. Tensile properties of filaments are normally at least as large as the properties for yarns, and tenacity values often are larger by as much as 3 gpd (2.6 dN/tex). Tensile properties reported in the examples, herein, are for filaments.

Linear Density

The denier or linear density of a filament is calculated from its fundamental resonant frequency determined by vibrating a 2 to 4 cm length of filament under tension with changing frequency. (ASTM D1577-66, part 25, 1968).

The denier or linear density of a yarn is determined by weighing a known length of the yarn. Denier is defined as the weight, in grams, of 9000 meters of the yarn.

In actual practice, the measured denier of a sample, test conditions and sample identification are fed into a computer before the start of a test; the computer records the load-elongation curve of the sample as it is broken and then calculates the properties.

Inherent Viscosity

Inherent viscosity ($\eta_{inh}$) is measured at 30° C. and computed from $$\eta_{inh} = ln(t_1/t_2)/c$$

where $t_1$ = solution flow time in the viscometer $t_2$ = solvent flow time in the viscometer c = polymer concentration of 0.5 g/dL, and the solvent is concentrated sulfuric acid (95–99 wgt %).

DESCRIPTION OF THE PREFERRED EMBODIMENTS

Preparation of poly-p-phenylene terephthalamide polymer (PPD-T)

Poly-p-phenylene terephthalamide polymer was prepared by dissolving 1,728 parts of p-phenylenediamine (PPD) in a mixture of 27,166 parts of N-methylpyrrolidone (NMP) and 2,478 parts of calcium chloride cooling to about 15° C. in a polymer kettle blanketed with nitrogen and then adding 3,243 parts of molten terephthaloyl chloride (TCl) with rapid stirring. The solution gelled in 3 to 4 minutes. The stirring was continued for 1.5 hours with cooling to keep the temperature below 25° C. The reaction mass formed a crumb-like product. The crumb-like product was ground into small particles which were then slurried with: a 23% NaOH solution; a wash liquor made up of 3 parts water and one part NMP; and, finally, water.

The slurry was then rinsed a final time with water and the washed polymer product was dewatered and dried at 100° C. in dry air. The dry polymer product had an inherent viscosity (IV) of 6.3, and contained less than 0.6% NMP, less than 440 PPM $Ca^{++}$, less than 550 PPM $Cl^-$, and less than 1% water. Preparation of fibers made from PPD-T.

An anisotropic spinning solution was prepared by dissolving the polymer in 100.1% sulfuric acid so as to produce a 19.3 wt. percent solution (44.3 g/100 ml sulfuric acid). The spinning solution was extruded through a spinneret at about 74° C. into a 4 mm air gap followed by a coagulating bath of 10% aqueous sulfuric acid maintained at a temperature of 3° C. in which overflowing bath liquid passed downwardly through an orifice along with the fibers. The spinneret had holes of 0.064 millimeter diameter to make yarn of 200 denier. The fibers were in contact with the coagulating bath liquid for about 0.025 seconds. The fibers were separated from the coagulating liquid, forwarded at 400 ypm and washed in two stages. In the first stage, water having a temperature of 15° C. was sprayed on the yarns to remove most of the acid. In the second stage, an aqueous solution of sodium hydroxide was sprayed on the yarns followed by a spray of water. In the second stage, the temperature of the liquid spray was 15° C. The exterior of the yarns was stripped of excess water and yarns were wound up without drying (yarn moisture of about 85%)

EXAMPLE 1

In this example, the wet fibers made above were subjected to the two-step, constant tension, treatment of this invention.

For each run in this Example, a length of the 200-denier never-dried yarn was fed through a nitrogen-purged tube oven between the jaws of an Instron tensile testing machine. With the temperature of the nitrogen set at 20°–30° C., a first tension of 14 gpd was applied to the wet fibers and maintained constant for 10–15 seconds. The breaking load for the static conditions of this treatment was found to be 18 gpd and the first tension was 77.8% of that.

The tension was then lowered to a second tension which was maintained constant during drying under mildly heated conditions of 175° C. for about 6 minutes.

The second tension for these experiments was varied from 3 to 10 gpd (20 to 71% of the first tension) but was maintained constant in each experiment. The second tension and tensile properties of the fibers made in this Example are reported in TABLE 1. The "Control" properties are for the same fibers dried under no tension at room temperature.

As a comparison experiment, these same never-dried fibers were treated by a process similar to that of the Japanese Laid-Open patent application (Kokai) Ser. No. 88,117/85 wherein the fibers were placed in the same oven between Instron jaws at 20°–30° C. under an initial tension at constant length and then were dried at that constant length rather than at constant tension. The initial tension was varied from 3 to 10 gpd and the resultant length was maintained for about six minutes during drying at 175° C. Tensile properties of filaments from the yarns made in the comparison experiments are reported in TABLE 1 as "C" runs.

TABLE 1

| Run No. | Second Tension (gpd) | Tenacity (gpd) | Elong. (%) | Modulus (gpd) |
|---|---|---|---|---|
| 1-1 | 3 | 26.4 | 2.5 | 1010 |
| 1-2 | 5 | 28.0 | 2.5 | 1070 |
| 1-3 | 7 | 28.7 | 2.6 | 1085 |
| 1-4 | 10 | 27.1 | 2.4 | 1095 |
| Control | 0 | 26.2 | 3.7 | 640 |
| | Initial | | | |

TABLE 1-continued

| | Tension | | | |
|---|---|---|---|---|
| 1-C1 | 3 | 25.3 | 2.7 | 915 |
| 1-C2 | 5 | 26.0 | 2.5 | 990 |
| 1-C3 | 7 | 27.4 | 2.5 | 1065 |
| 1-C4 | 10 | 25.3 | 2.3 | 1065 |

Referring to FIG. 1, the fibers of this invention are designated as "2 stage" and the fibers of the comparison experiment are designated as "Const. L". It can be seen that the modulus for fibers made in accordance with this invention is higher than the modulus for fibers made with a constant length across the entire range of drying tensions.

EXAMPLE 2

In this example, additional wet fibers made above were subjected, in a dynamic embodiment, to the two-step, constant tension, treatment of this invention.

The 200-denier never-dried yarn was fed through a set of magnetic brakes then to a drive roll between which tension could be applied under ambient conditions to the water swollen yarn. The yarn coming off this first drive roll was passed through a tube oven through which heated nitrogen was introduced to dry the yarn A second drive roll following the tube oven controlled the residence time and yarn tension in the drying oven.

The first tension was applied at less than 50° C. and was applied and maintained constant at two, relatively high levels. The second tension and the drying was conducted at about 175° C. for a time of about 15 seconds; and the constant tension was changed from run to run through the example. Even though the static breaking load for the fibers was, as reported in Example 1, 18 gpd, the breaking load for the dynamic conditions of the treatment of this example was 15 gpd. Tensile properties of the filaments made in this example are reported in TABLE 2. The "Control" properties are for samples of the same fibers dried under no tension at room temperature. The Control fiber exhibited a T/E/M of 28.2/4.2/605.

In a second series of experiments, also, utilizing a relatively high first tension and varied second tensions, the same fibers were analyzed which had been dried at about 350° C. for about 5 seconds. The runs of the second series are indicated in TABLE 2 with primes, as "2'-n".

In a comparison experiment, these same never-dried fibers were treated by a process wherein the first tension was very low and the second tension was either very low or was more than the first tension. Tensile properties of the filaments made in the comparison experiments are reported in TABLE 2 as "C" runs.

TABLE 2

| Run | 1st tens. (gpd) | % brk | 2nd tens. (gpd) | % 1st | Ten. (gpd) | elg. (%) | mod. (gpd) |
|---|---|---|---|---|---|---|---|
| 2-1 | 10 | 67 | 1.3 | 13 | 27.8 | 2.8 | 975 |
| 2-2 | 10 | 67 | 3.2 | 32 | 28.4 | 2.8 | 1030 |
| 2-3 | 10 | 67 | 6.4 | 64 | 26.1 | 2.5 | 1040 |
| 2-4 | 12 | 80 | 1.4 | 12 | 28.5 | 2.9 | 990 |
| 2-5 | 12 | 80 | 3.1 | 26 | 26.9 | 2.6 | 1035 |
| 2-6 | 12 | 80 | 6.2 | 52 | 26.4 | 2.5 | 1040 |
| Cont. | 0 | — | — | — | 28.2 | 4.2 | 605 |
| 2'-4 | 12 | 80 | 1.6 | 13 | 25.1 | 2.3 | 1010 |
| 2'-5 | 12 | 80 | 3.1 | 26 | 24.7 | 2.1 | 1080 |
| 2'-6 | 12 | 80 | 4.7 | 39 | 23.9 | 2.0 | 1160 |
| 2-C1 | 2 | 13 | 1.1 | 55 | 26.3 | 3.2 | 815 |

TABLE 2-continued

| Run | 1st tens. (gpd) | % brk | 2nd tens. (gpd) | % 1st | Ten. (gpd) | elg. (%) | mod. (gpd) |
|---|---|---|---|---|---|---|---|
| 2-C2 | 2 | 13 | 2.7 | 135 | 26.3 | 2.9 | 920 |
| 2-C3 | 2 | 13 | 6.5 | 325 | 28.5 | 2.8 | 1020 |
| 2-C4 | 4 | 27 | 1.4 | 35 | 26.4 | 3.1 | 860 |
| 2-C5 | 4 | 27 | 3.5 | 88 | 28.0 | 3.0 | 950 |
| 2-C6 | 4 | 27 | 6.5 | 162 | 26.9 | 2.6 | 1025 |

Figure 2:
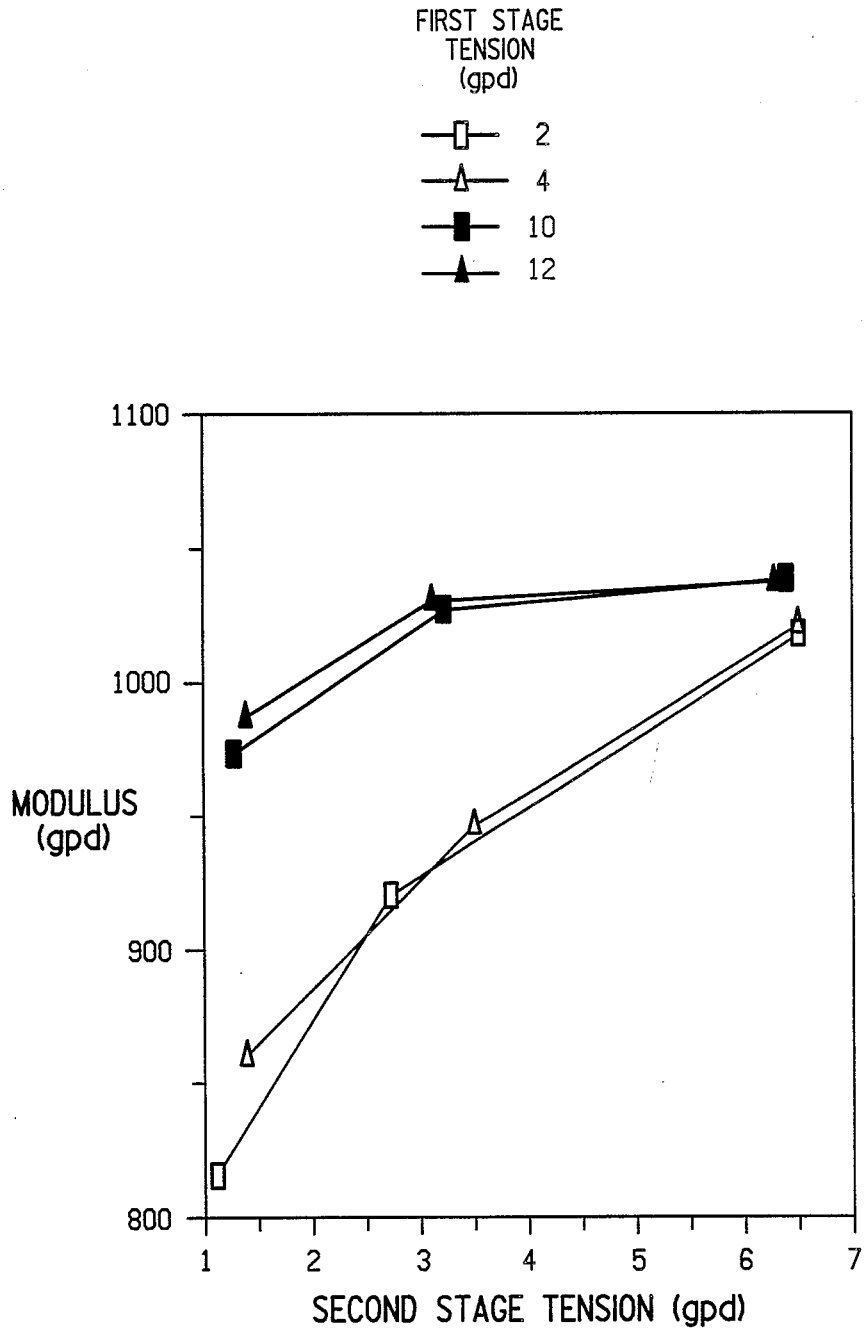
FIG. 2 is a graphical representation of the benefits of this process in achieving increased filament moduli by a high stress draw of the fibers when wet followed by a high stress draw during the fiber drying.

Referring to FIG. 2, the fibers of this invention are represented by the two upper curves which are designated to have first stage tensions of 10 and 12 gpd; and the fibers of the comparison experiment are represented by the two lower curves which are designated to have first stage tensions of only 2 and 4 gpd. It should be noted that low tenacities and low moduli result from the low second tensions coupled with low first tensions of the comparison runs, while, the high first tensions of the invention permit high tenacities and moduli across a wide range of drying tensions.

EXAMPLE 3

In Example 1, the practice of this invention was demonstrated by a series of experiments with a single constant first tension and a variety of constant second tensions. In Example 2, there was a demonstration of two levels of first constant tension and a variety of constant second tensions. In this example, fibers are analyzed which have been processed using several first constant tensions and a narrow range of constant second tensions.

Wet fibers made above were subjected to the two-step, constant tension, treatment of this invention.

The magnetic brakes, the drive rolls, and the oven were the same as those used in Example 2.

The first tension was applied at less than 50° C. and the constant tension was changed from run to run through the example. The second constant tension and the drying was conducted at about 175° C. for a time of about 15 seconds; and the constant tension was maintained within a narrow range of 2.7–3.5 gpd. The breaking load for the never-dried fibers of this example, under the conditions of the treatment herein, was 15 gpd. Tensile properties of the filaments made in this example are reported in TABLE 3.

TABLE 3

| Run | 1st tens. (gpd) | % brk | 2nd tens. (gpd) | % 1st | Ten. (gpd) | elg. (%) | mod. (gpd) |
|---|---|---|---|---|---|---|---|
| 3-1 | 2 | 13 | 2.7 | 135 | 26.3 | 3.2 | 815 |
| 3-2 | 4 | 27 | 3.5 | 88 | 28.0 | 3.0 | 950 |
| 3-3 | 6 | 40 | 3.4 | 57 | 29.1 | 2.9 | 1035 |
| 3-4 | 8 | 53 | 3.0 | 38 | 28.5 | 2.8 | 1000 |
| 3-5 | 10 | 67 | 3.2 | 32 | 28.4 | 2.8 | 1030 |
| 3-6 | 12 | 80 | 3.1 | 26 | 26.9 | 2.6 | 1035 |
| 3-7 | 14 | 93 | 3.2 | 23 | 25.4 | 2.4 | 1035 |

EXAMPLE 4

In this example, fibers were analyzed as a function of the temperatures used to dry them.

Wet fibers made above were subjected to the two-step, constant tension, treatment of this invention.

The magnetic brakes, the drive rolls, and the oven were the same as those used in the previous examples.

A first constant tension of 12.5 gpd was applied to the never-dried fibers at less than 50° C. and was maintained for 10–15 seconds. The second constant tension and the drying was conducted at varying temperatures for a time of about 15 seconds; and the constant tension was maintained within a narrow range of 2.5–3.5 except where the high temperatures dictated a lower tension to reduce fiber breakage. The breaking load for the never-dried fibers of this example, under the conditions of the treatment herein, was about 15 gpd and the first constant tension was about 83% of that break strength. Tensile properties of the filaments made in this example are reported in TABLE 4.

TABLE 4

| Run | drying temp. (°C.) | 2nd tens. (gpd) | % 1st | Ten. (gpd) | elg. (%) | mod. (gpd) |
|---|---|---|---|---|---|---|
| 4-1 | 175 | 3.5 | 28 | 28.9 | 2.8 | 1040 |
| 4-2 | 250 | 3.5 | 28 | 27.8 | 2.6 | 1060 |
| 4-3 | 350 | 2.5 | 20 | 26.1 | 2.4 | 1040 |
| 4-4 | 450 | 1.7 | 14 | 23.4 | 2.0 | 1130 |
| 4-5 | 550 | 1.5 | 13 | 20.1 | 1.6 | 1055 |

I claim:

1. A process for preparing high modulus, high tenacity fibers of aromatic polyamide, comprising the steps of extruding an anisotropic solution of the polyamide in 98.0 to 100.2% sulfuric acid having a polyamide concentration of at least 30 g/100 ml sulfuric acid through a layer of non-coagulating fluid into a coagulating bath to yield fibers, washing the fibers, applying a first constant tension within 40–95% of the fiber breaking load to the washed fibers at a temperature of less than 50° C. for a duration of greater than 5 seconds, and drying the fibers at a second constant tension which is from 10–100% of the first constant tension and at a temperature of more than the temperature of the first constant tension and less than 350° C. until the fibers have a moisture content of about 2 to 10%.

2. Process of claim 1 wherein the aromatic polyamide is poly(p-phenylene terephthalamide).

3. Process of claim 1 wherein the tension on the fibers during the drying is at least 3 gpd.

4. Process of claim 3 wherein the moisture content of the coagulated or washed fibers is at least 15% prior to drying.

5. Process of claim 4 wherein the aromatic polyamide is poly(p-phenylene terephthalamide).

6. Process of claim 4 wherein the tension on the washed fibers prior to drying is at least 8 gpd.

7. Process of claim 6 wherein the aromatic polyamide is poly(p-phenylene terephthalamide).

* * * * *